US007686503B2

(12) United States Patent
Rochat et al.

(10) Patent No.: US 7,686,503 B2
(45) Date of Patent: Mar. 30, 2010

(54) WATCH ESCAPEMENT

(75) Inventors: Daniel Rochat, Saint-Blaise (CH); Elio Mariotto, Solothurn (CH)

(73) Assignee: Rolex S.A., Geneva (CH)

( * ) Notice: Subject to any disclaimer, the term of this patent is extended or adjusted under 35 U.S.C. 154(b) by 248 days.

(21) Appl. No.: 11/910,863

(22) PCT Filed: Mar. 30, 2006

(86) PCT No.: PCT/EP2006/061169

§ 371 (c)(1),
(2), (4) Date: Oct. 5, 2007

(87) PCT Pub. No.: WO2006/106066

PCT Pub. Date: Oct. 12, 2006

(65) Prior Publication Data

US 2008/0279052 A1 Nov. 13, 2008

(30) Foreign Application Priority Data

Apr. 6, 2005 (EP) ..... 05102703

(51) Int. Cl.
*G04B 15/00* (2006.01)

(52) U.S. Cl. ..... 368/127

(58) Field of Classification Search ..... 368/124–133
See application file for complete search history.

(56) References Cited

U.S. PATENT DOCUMENTS 3,538,705 A * 11/1970 Perry ..... 368/125
6,942,378 B2 * 9/2005 Hayek et al. ..... 368/127
7,396,154 B2 * 7/2008 Houlon ..... 368/127
7,458,717 B2 * 12/2008 Baumberger et al. ..... 368/127

FOREIGN PATENT DOCUMENTS

CH 101 849 A 11/1923
EP 0018796 A2 * 11/1980
GB 842 150 A 7/1970

OTHER PUBLICATIONS

International Search Report of PCT/EP2006/061169, date of mailing Jul. 25, 2006.
Written Opinion of Corresponding International Patent Application No. PCT/EP2006/061169 dated Oct. 18, 2007.

* cited by examiner

*Primary Examiner*—Edwin A. Leon
(74) *Attorney, Agent, or Firm*—Westerman, Hattori, Daniels & Adrian, LLP

(57) ABSTRACT

An escapement for a mechanical watch comprising: an escapement wheel (10) kinematically connected to a power source, a roller (14) mounted on a balance (16) including, on two different levels, a pin (23) and an impulse pallet (24) co-operating with said wheel (10); a limiting member (26) performing a periodic movement during which it co-operates with the pin (23) to limit the travel of said roller (14); a control member (30) provided with a rest lift (32) performing, from a stable position wherein said wheel (10) is pressed on the rest lift (23), a periodic movement during which the wheel is released and provides an impulse to the impulse pallet (24). The periods of the limiting member (26) and of the control member (30) correspond, respectively, to an alternation and an oscillation of the balance.

4 Claims, 17 Drawing Sheets

WATCH ESCAPEMENT

TECHNICAL FIELD

The present invention relates to the field of horology. It relates, more particularly, to a mechanical watch mechanism known by the name of an escapement.

The object of the escapement is to maintain and count the oscillations of the balance wheel of a watch (or of the pendulum of a clock). It receives the power dispensed at the base by the barrel, through the work train, and periodically releases a parcel of this motive power in order to return to the regulating member the power which is lost by the frictions. The escapement is a distributing member which converts the rotary movement of the train into an alternative movement. Numerous works have focused on describing the different escapement mechanisms. Reference can be made to "Théorie de l'horlogerie" by Reymondin et al, Fédération des Ecoles Techniques, 1998, ISBN 2-940025-10-X, pages 99 to 128.

PRIOR ART

The most common escapement is the Swiss lever escapement, described in detail in the reference already cited. But one particular type of escapement, known by the name of detent escapement, has a better mechanical efficiency. It appeared around about the XVIII century, when maritime nations competed to construct the most accurate possible horological instrument, which would allow the most reliable determination of the geographical position at sea.

A detent escapement is represented in FIG. 1. It comprises, in the traditional manner, an escape wheel 1 kinematically connected to a barrel, and a detent 2. A double roller 3 bears an impulse pallet 4 cooperating with the escape wheel 1 and a release pallet 5 working with the end of the detent 2. The latter has an elbow, bearing a locking pallet 6, on which the wheel 1 can come to bear. Springs 7 and 8 allow the different supports to be maintained.

This type of escapement has certain drawbacks which make it particularly difficult to install in a wristwatch. In particular, it is sensitive to impacts. If a side impact releases the locking pallet 6, the mechanism races. Moreover, if the amplitude of the balance wheel exceeds 360°, the escape wheel makes a double-jump, also referred to as a trip. Finally, it is not self-starting. This means that when the watch is rewound when it has stopped, it is necessary to set the balance wheel in oscillation by rapidly rotating the watch.

The object of the present invention is to propose an escapement system which exploits the mechanical efficiency of a detent escapement, without exhibiting the drawbacks thereof.

DISCLOSURE OF THE INVENTION

More precisely, the invention relates to an escapement for a mechanical watch comprising:

- an escape wheel kinematically connected to a power source,
- a roller mounted on a balance wheel including, on two different levels, a pin and an impulse pallet cooperating with the escape wheel,
- a limiting member performing a periodic movement in the course of which it cooperates with the pin to limit the travel of the roller,
- a control member provided with a locking pallet pin performing, from a stable position in which the escape wheel is bearing upon the locking pallet pin, a periodic movement in the course of which this wheel is freed and provides an impetus to the impulse pallet.

According to the invention, the period of movement of the limiting member corresponds to a swing of said balance wheel and the period of movement of the control member is less than an oscillation of the balance wheel.

As is known by the person skilled in the art, the balance wheel makes an oscillatory movement, an oscillation of the balance wheel comprising a first swing, in the course of which the balance wheel pivots in a first direction, and a second swing, in the course of which the balance wheel pivots in the second direction.

Advantageously, the limiting member is made up of a first arm mounted pivotably about an axis. It ends in a fork cooperating with the pin so as to move between a first and a second stable position defined by a first and a second stop. The limiting member additionally comprises a pulling system ensuring that this arm is held in the first and second stable positions.

The control member is made up of:

- a second arm rotatable about a pivot point and cooperating at least mediately with the roller in order to leave its stable position, and
- a return system for returning the second arm to its stable position after the impetus.

In a first embodiment, the pulling member comprises a jumper and a pallet cooperating elastically one with the other and disposed one on the first arm, the other on the second arm. This pulling member joins together the first and second arms when the second one leaves its stable position.

Advantageously, the two arms are mounted pivotably about a same axis.

In a second embodiment, in order to expel the second arm from its stable position, the roller additionally includes a release pallet. Moreover, the second arm, on the one hand, bears an elastic member, the end of which is designed to cooperate with the release pallet and, on the other hand, extends into a beak, which ends in such a way as to be laterally in contact with the elastic member, close to its end.

Advantageously, the beak crosses the elastic member and ends in a portion perpendicular to the plane of the arm.

In this second embodiment, the pulling system is magnetic or includes a bistable spring cooperating with the first arm.

In a first variant in which the locking pallet pin is disposed on a first side of the second arm relative to its pivot point, the return system includes a portion of the second arm, disposed on the other side of the pivot point, and a return pallet situated on this portion and designed to cooperate with the escape wheel.

In a second variant, the return system is formed by boards standing on edge and coupled to the teeth of the escape wheel, and a return pin disposed on the second arm and designed to cooperate with the inner surface of the boards.

BRIEF DESCRIPTION OF THE DRAWINGS

Other details of the invention will emerge more clearly from a reading of the following description, made with reference to the appended drawing, in which.

So as not to overload the drawings, the bridges and the plate of the watch movement in which the escapement mechanism according to the invention is accommodated have not been represented. It is evident that the different mobiles pivot on their axes disposed in jewel holes or other bearings perfectly well known to the person skilled in the art, without there being any need to describe these.

EMBODIMENT(S) OF THE INVENTION

First Embodiment

Figure 2:
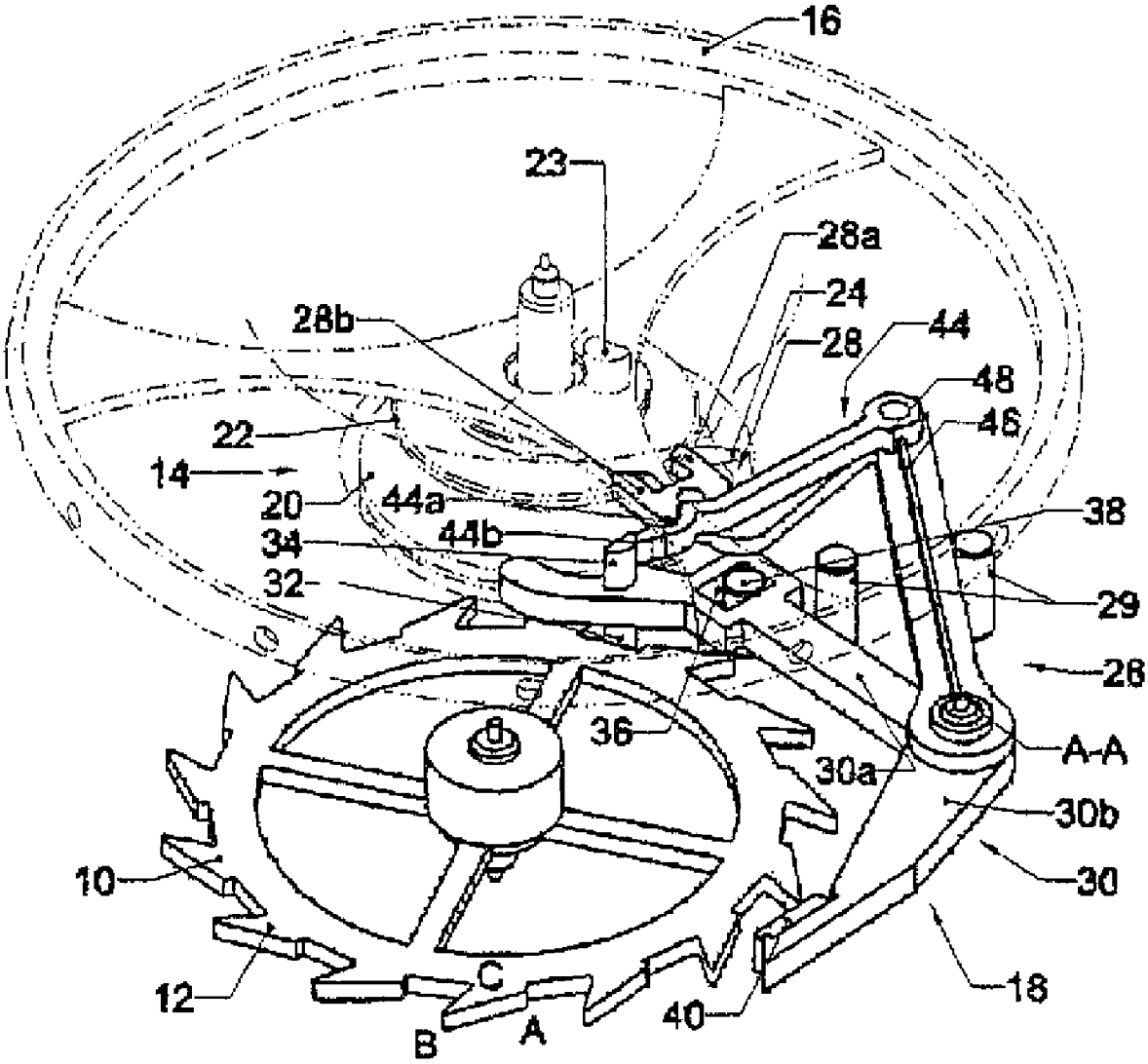
FIG. 2 is a perspective view of an escapement mechanism according to the invention.

In FIG. 2 has been represented an escape wheel 10 kinematically connected to the barrel (not represented) of a mechanical watch movement. This wheel 10 is provided with teeth 12 designed to cooperate, on the one hand, with a roller 14 mounted on a balance wheel 16 and, on the other hand, with a lever 18.

The teeth 12 have, in particular, a plane BC, which, as will be explained by the following description, plays the role of locking plane and impulse plane, and a plane AB, the intersection of the planes defining the point of the teeth.

The roller 14 includes two levels, the lower level 20 and the upper level 22, mounted coaxially. The lower level receives an impulse pallet 24, while a pin 23 is disposed on the upper level 22.

The lever 18 is equipped with a first arm 26 mounted pivotably about an axis AA, acting as a limiting member for the travel of the balance wheel 16. It is cranked in shape and ends in a fork 28, similar to that of a Swiss lever escapement and comprising, in particular, an entry 28*a* and an exit 28*b* and a guard pin 28*c* (visible in FIGS. 3 to 17). Its travel is limited by two fork stops 29, disposed on either side of the arm 26. The fork 28 cooperates with the pin 23 of the level 20.

The lever 18 additionally includes a second arm 30, mounted pivotably with reference to the first arm, likewise about AA. This arm acts as a control member, since, as will come to be realized below, it frees and stops the escape wheel 10. The pivot point separates this arm 30 into a so-called locking part 30*a* and a second, so-called return part 30*b*.

The locking part 30*a* has, at its end and on its lower face, a locking pallet pin 32 designed to cooperate with the teeth 12 of the escape wheel 10. It is likewise equipped, on its upper face, with a bearing pallet 34, the role of which will become apparent later, and with an opening 36, inside which there is accommodated a stop 38. The latter allows the travel of the arm 30 to be limited.

The return part 30*b* ends in a return pallet 40 designed to cooperate with the teeth 12. These elements form a return system, the working of which is explained below. Moreover, this part plays the role of counterweight for the part 30*b* and thus facilitates the pivoting of the arm 30 in the vertical positions of the mechanism.

The arms 26 and 30 are mutually connected by a jumper 44, cooperating with a wire spring 46. The jumper is mounted slightly pivotably in the elbow of the arm 26 and has a nib 48 close to its pivot point. Its end cooperates with the pallet 34 and is configured to provide two stable bearing surfaces 44*a* and 44*b* on this pallet 34, which additionally plays the role of a pulling system. The spring 46 is mounted on the arm 26 and acts upon the lug 48 to support the jumper 44 against the pallet 34.

The working of the mechanism is illustrated in FIGS. 3 to 8.

FIG. 3

The escapement is locked and the balance wheel is in the descending portion of its swing and is turning counterclockwise. The pin 23 and the impulse pallet 24 are free. The first bearing surface 44*a* of the jumper 44 cooperates with the pallet 34. The escape wheel 10 is fixed, the plane BC of one of its teeth 12 bearing upon the locking pallet pin 32. This generates a pull holding the arms 26 and 30 of the lever 18 in a first stable position, in which the arms 26 and 30 are respectively bearing upon a first of the stops 29 and upon a first flank of the stop 38. The pallet 40 of the return arm 30*b* is set back from the escape wheel 10.

FIG. 4

The balance wheel 16 pursues its swing and the pin 23 enters into contact with the entry 28*a* of the fork 28, in much the same way as occurs with a Swiss lever escapement. The arm 26 is then set in rotation about the axis AA in the clockwise direction. By virtue of the jumper 44 and the spring 46, the arm 30 is driven in the same movement. In this way, the parts which constitute the lever 18 are fixedly connected.

FIG. 5

The movement of the arm 30 brings about the release of the escape wheel 10, which is freed from its bearing contact upon the locking pallet pin 32. The wheel 10 then turns in the clockwise direction, kinematically driven by the barrel. The lever 18 pursues its pivot movement about AA, still driven by the pin 23, whereby the pallet 40 of the return arm 30*b* is brought into contact with a tooth 12.

FIG. 6

The pallet 40 and the arm 30*b* are stopped in their movement. The arm 26 is fully independent and maintains its initial movement in the clockwise direction, still under the effect of the pin 23. Consequently, the pallet 34 leaves the first bearing surface 44*a* of the jumper 44 and slides toward the second one 44*b*.

Moreover, the plane BC of the neighboring tooth to that which has just left the bearing pallet 34 enters into contact with the pallet 24 in order to provide the impetus.

FIG. 7

Figure 3:
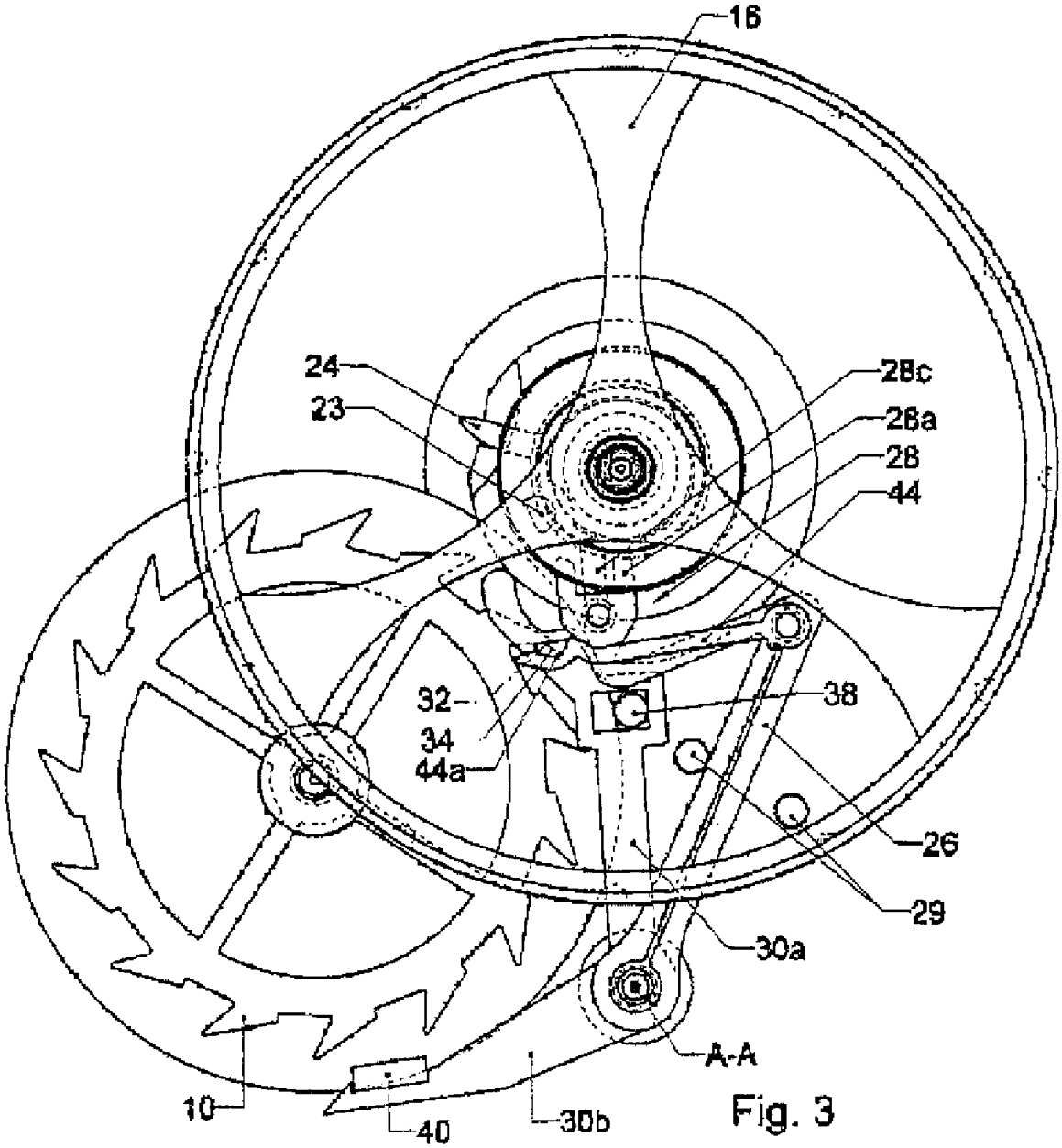
FIGS. 3 to 8 represent the cycle of said mechanism.
Figure 4:
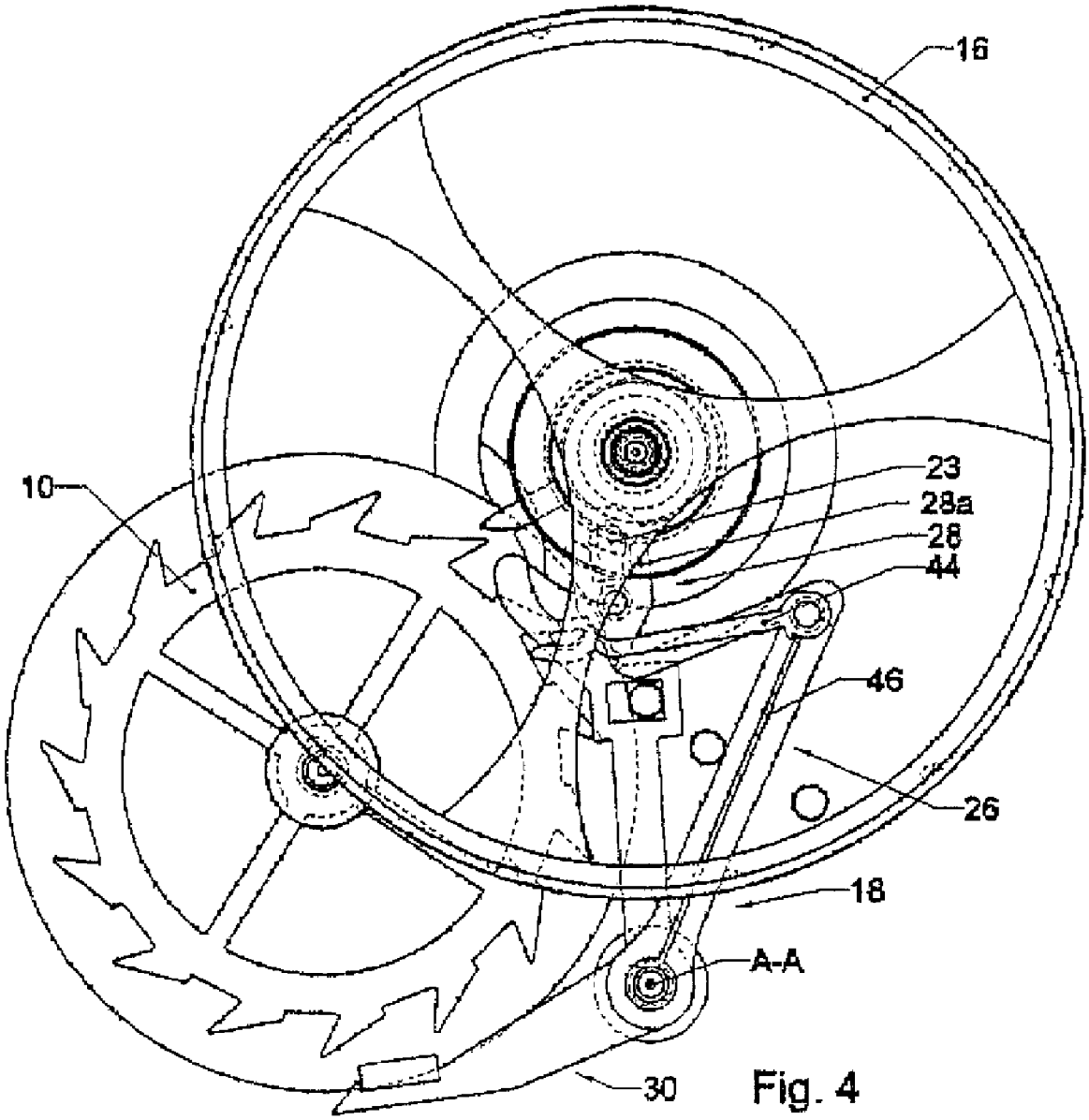
Figure 5:
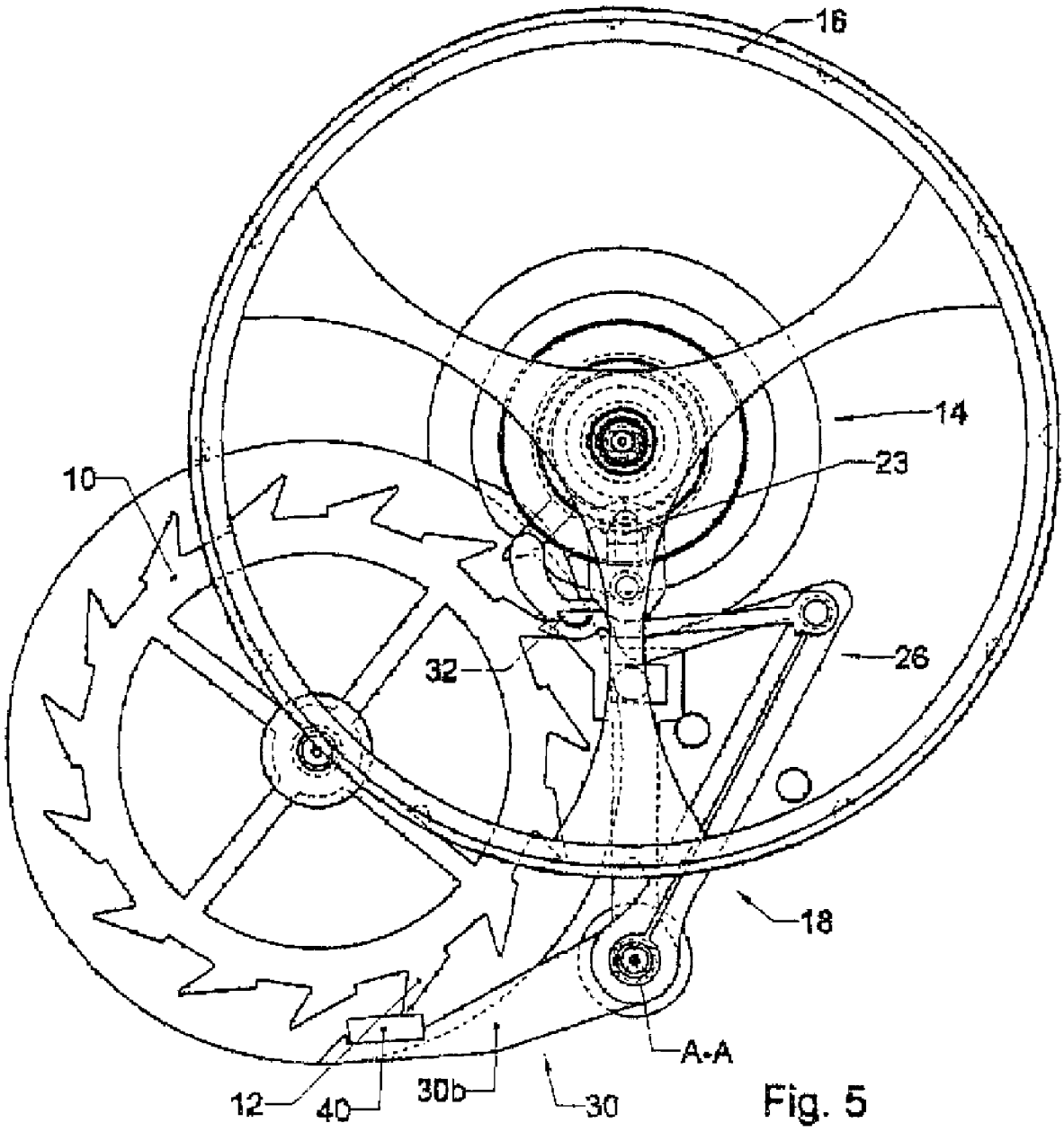
Figure 6:
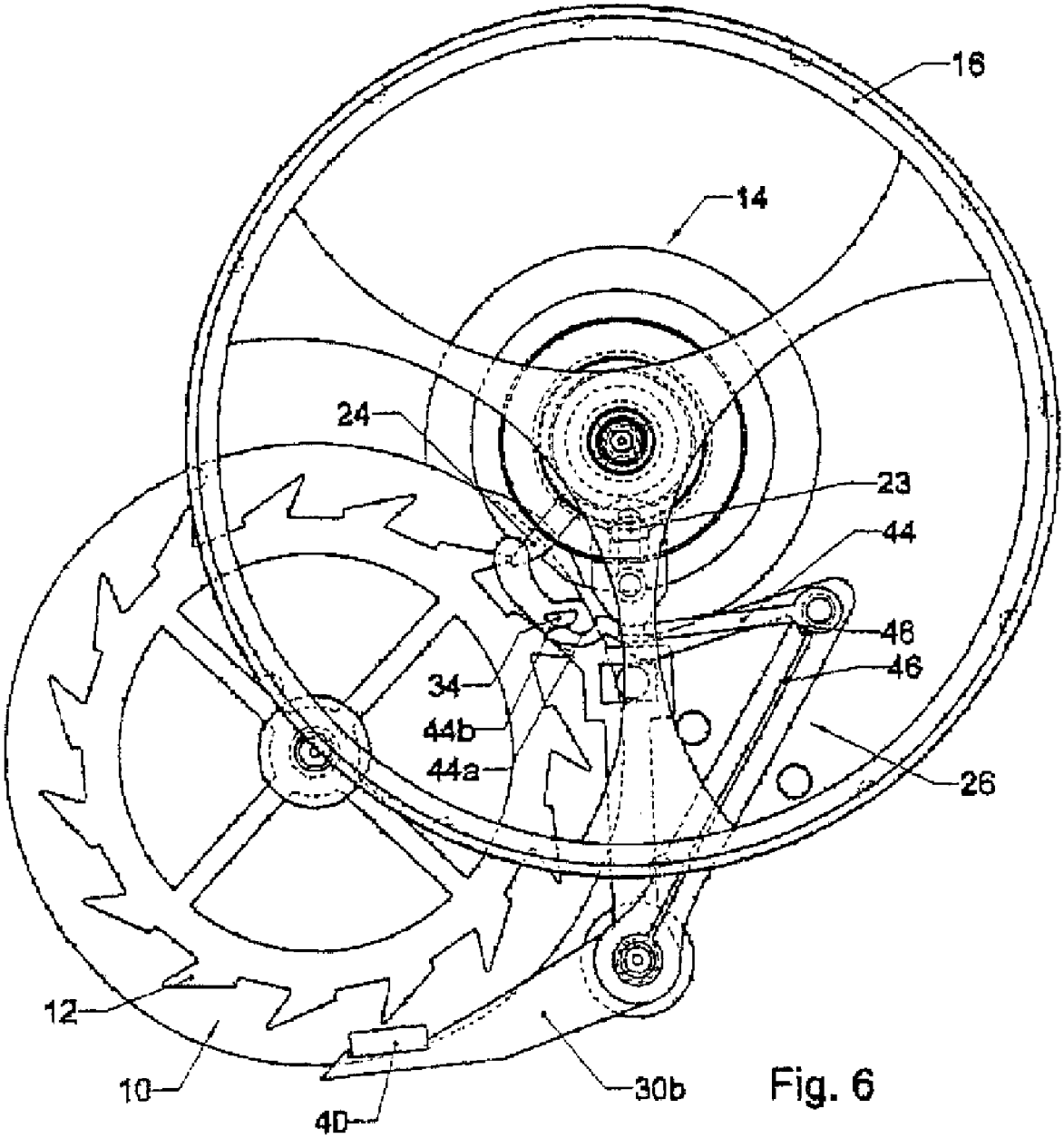
Figure 7:
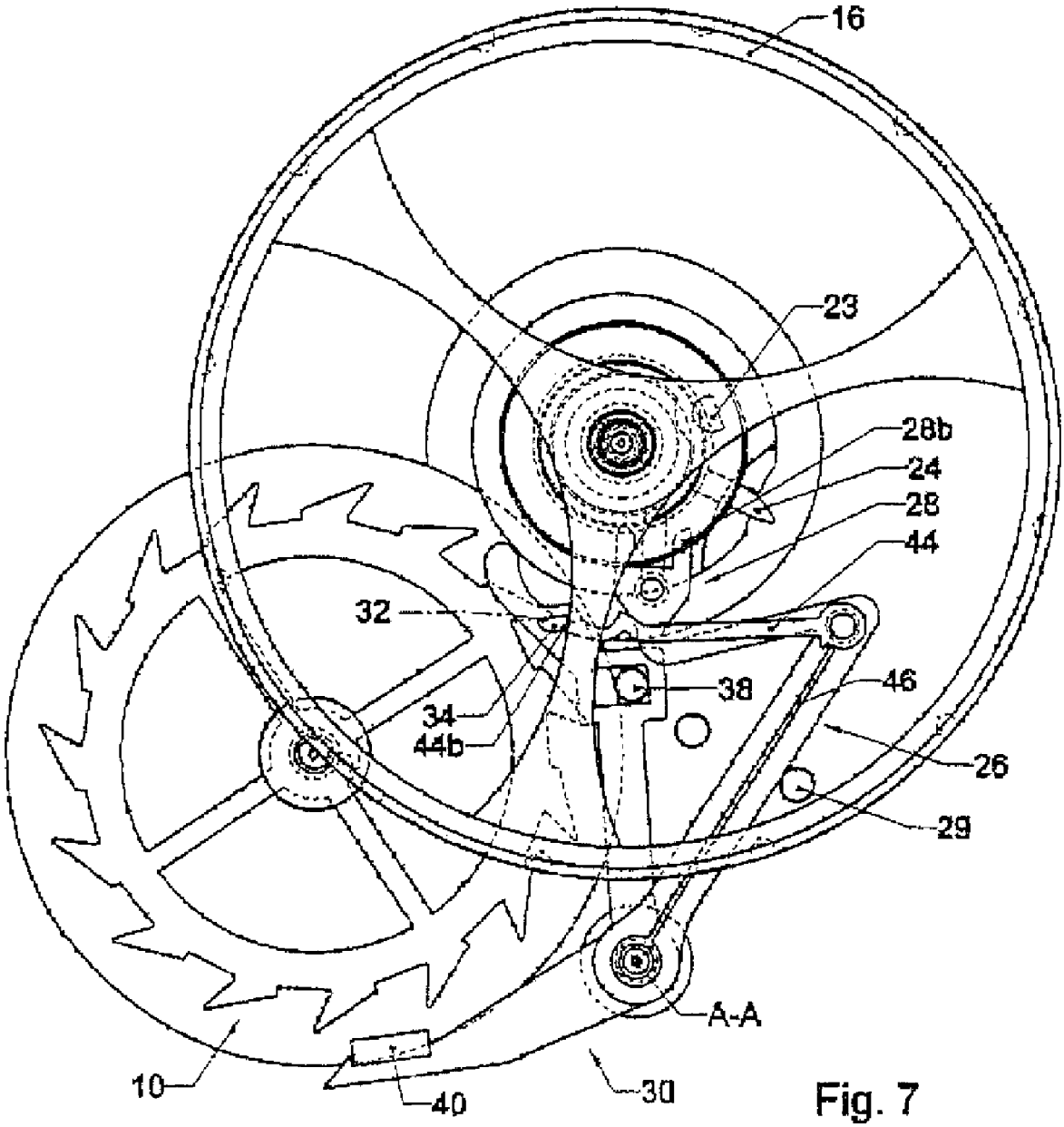
Figure 8:
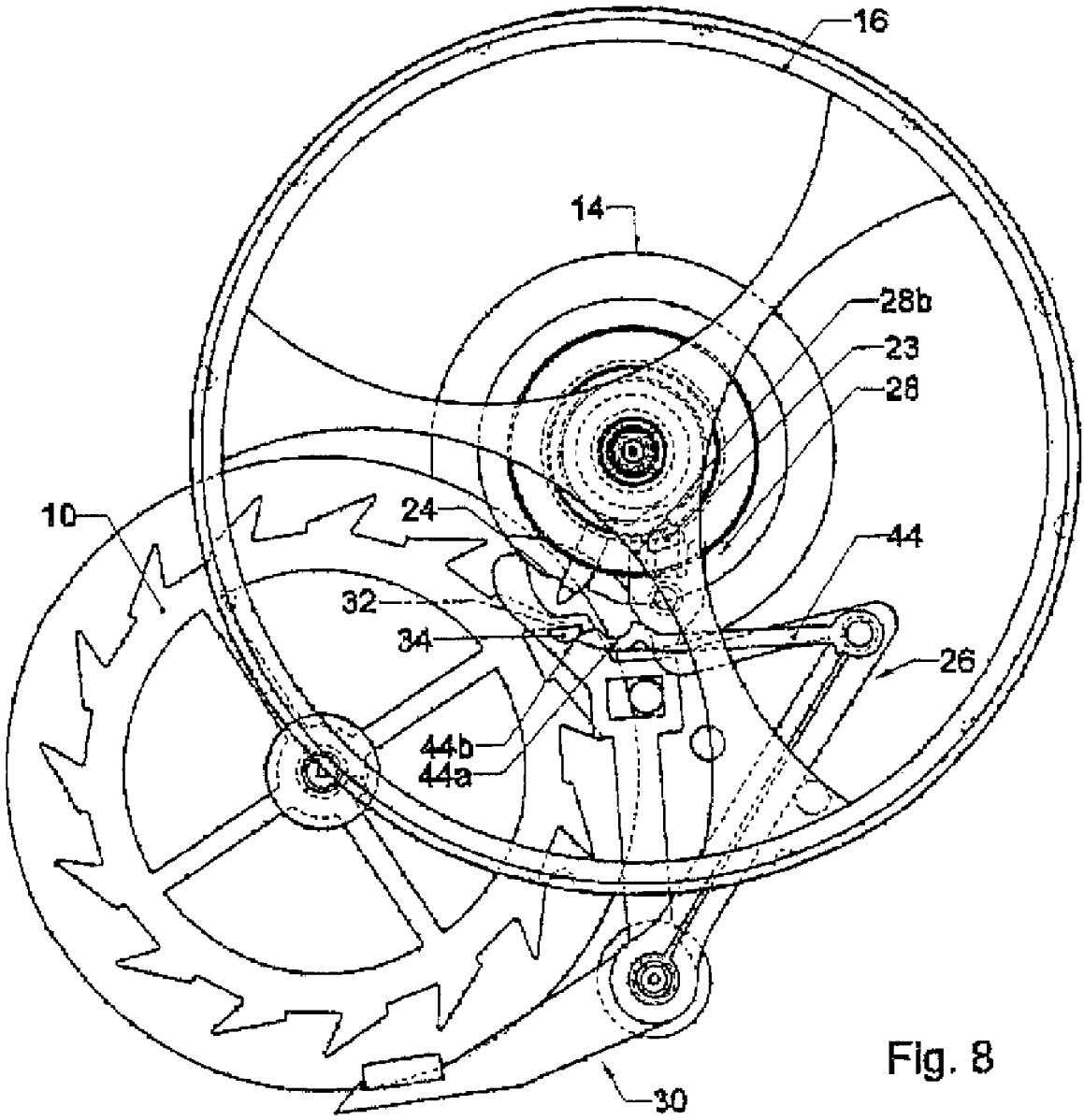

The pin 23 leaves the fork 28, and the pallet 24 leaves the tooth 12 such that the balance wheel 16 oscillates freely in the ascending portion of its swing. It is now the second bearing surface 44*b* of the jumper 44 which cooperates with the pallet 34. Under the effect of the jumper 44 passing from one to the other of its stable positions, the arm 30 is brought into its initial position, such as represented in FIG. 3. The surface 44*b* is orientated in such a way as to produce a pull holding the arms 26 and 30 of the lever 18 in a second stable position, in which they are respectively bearing upon the second of the stops 29 and upon the first flank of the stop 38. The escape wheel 10 is fixed, the tooth 12 which has just provided the impetus being in bearing contact upon the locking pallet pin 32. The pallet 40 of the return arm 30*b* is set back from the escape wheel 10.

Thus, the control member 30 has performed a periodic movement for a period less than the first swing of the oscillation of the balance wheel.

FIG. 8

The balance wheel 16 and the roller 14 turn in the clockwise direction and are in the descending portion of their following swing. The second surface 44*b* is still in bearing contact upon the pallet 34 and the wheel 10 is fixed, bearing upon on the locking pallet pin 32.

The pallet 24 and the pin 23 pursue their descending cycle and the latter enters into contact with the exit 28*b* of the fork 28, thus returning the lever into its initial position of FIG. 3. The limiting member 26 therefore performs its periodic movement during the period of the oscillation of the balance wheel.

Once the balance wheel has completed its swing, a new cycle, such as described above, commences, and so on.

Second Embodiment

Figure 9:
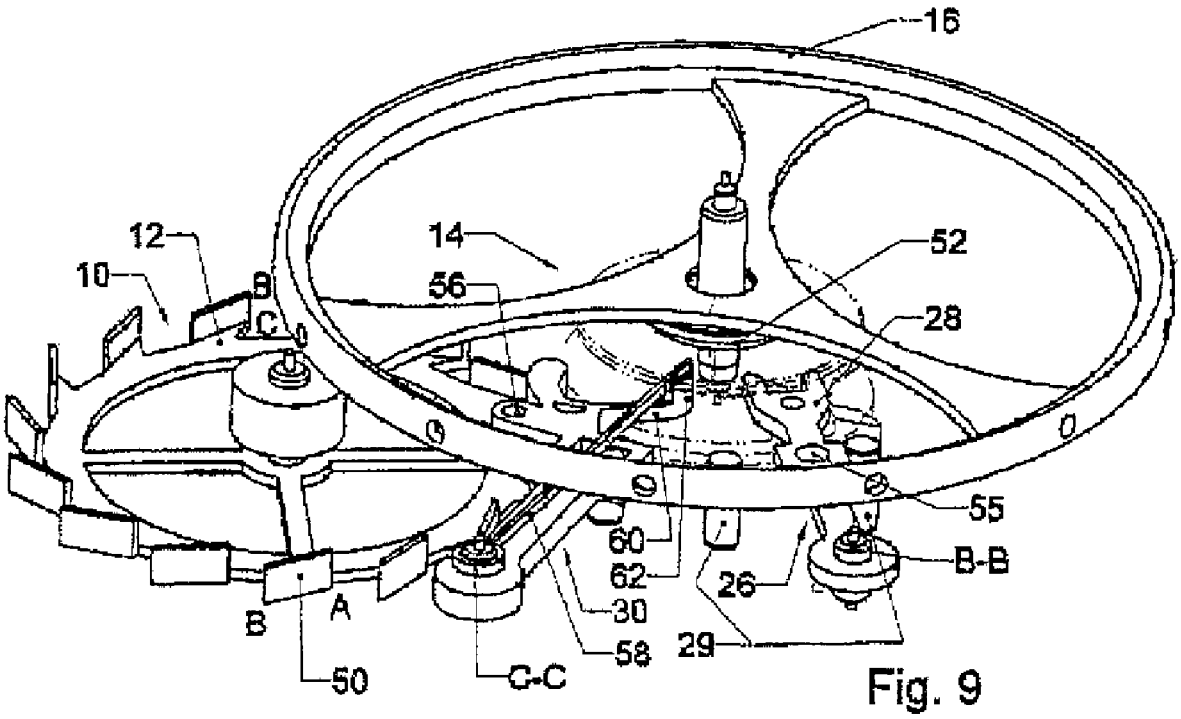
FIG. 9 is a perspective view of a second embodiment according to the invention.

In FIG. 9, the escape wheel 10 has an on-edge structure. More precisely, the plane AB of the teeth 12 of the escape wheel 10 is extended by a board 50 rising perpendicularly to the plane of the wheel.

Figure 10:
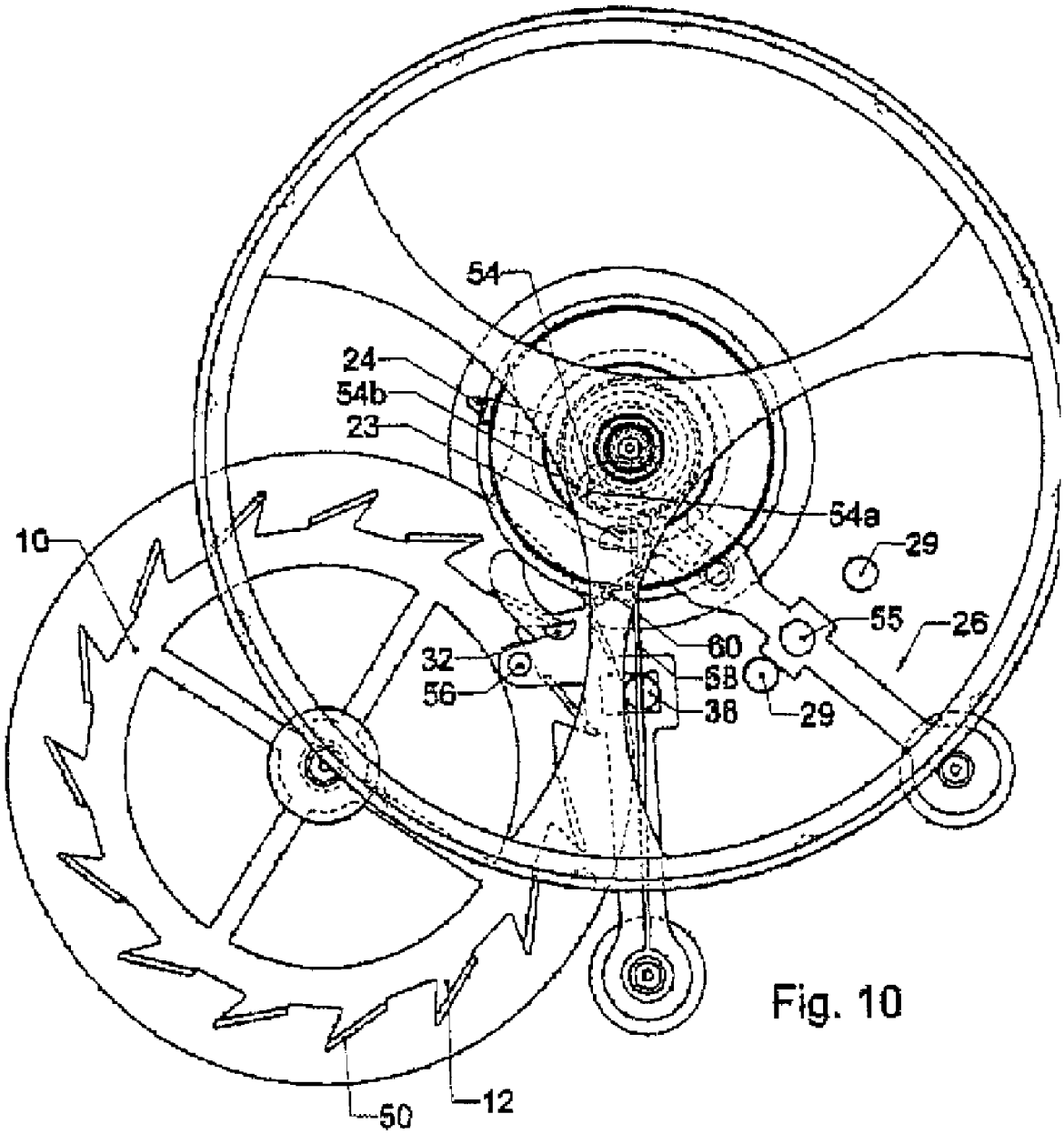
FIGS. 10 to 16 illustrate the cycle of this second mechanism.
Figure 11:
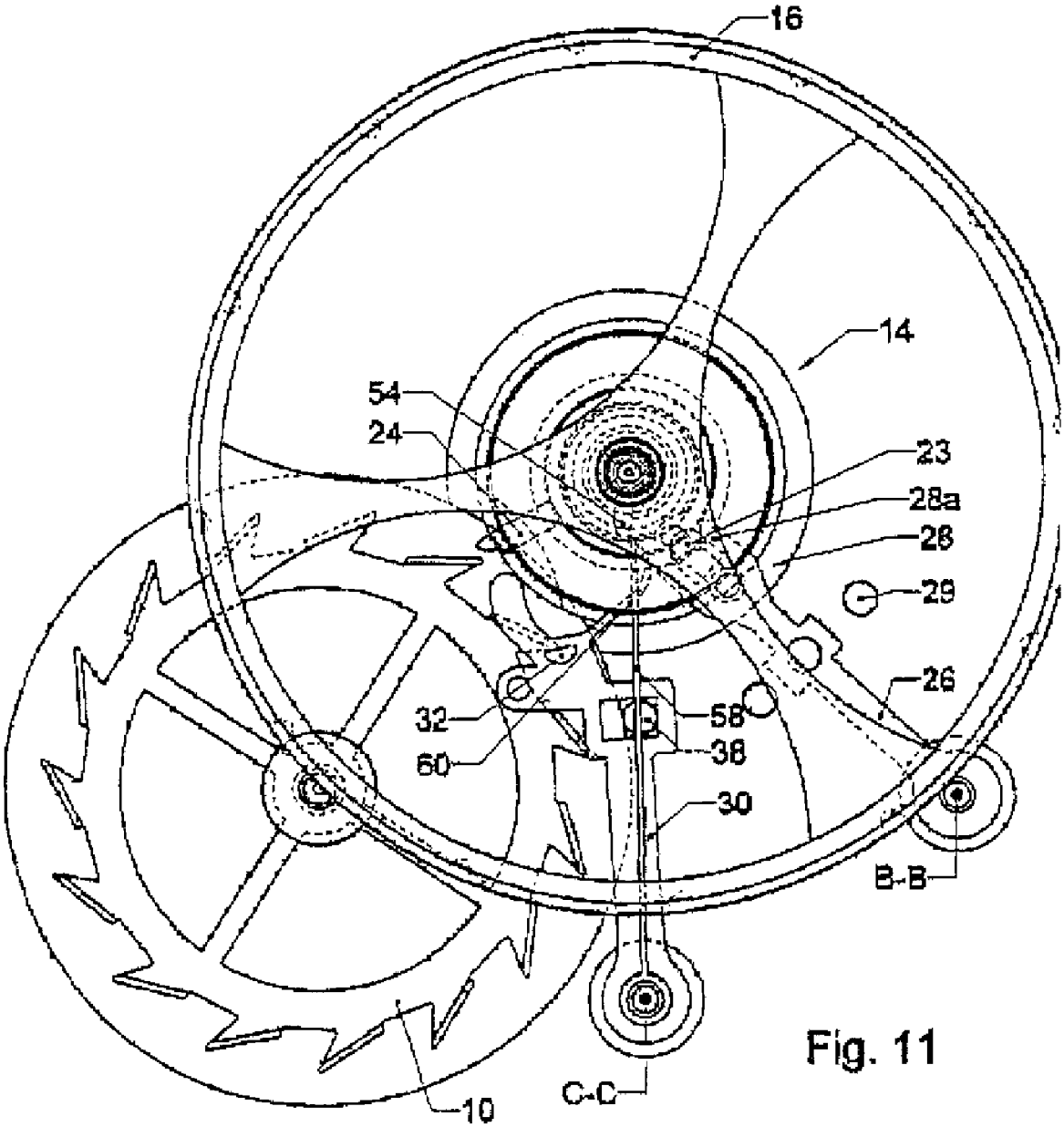
Figure 12:
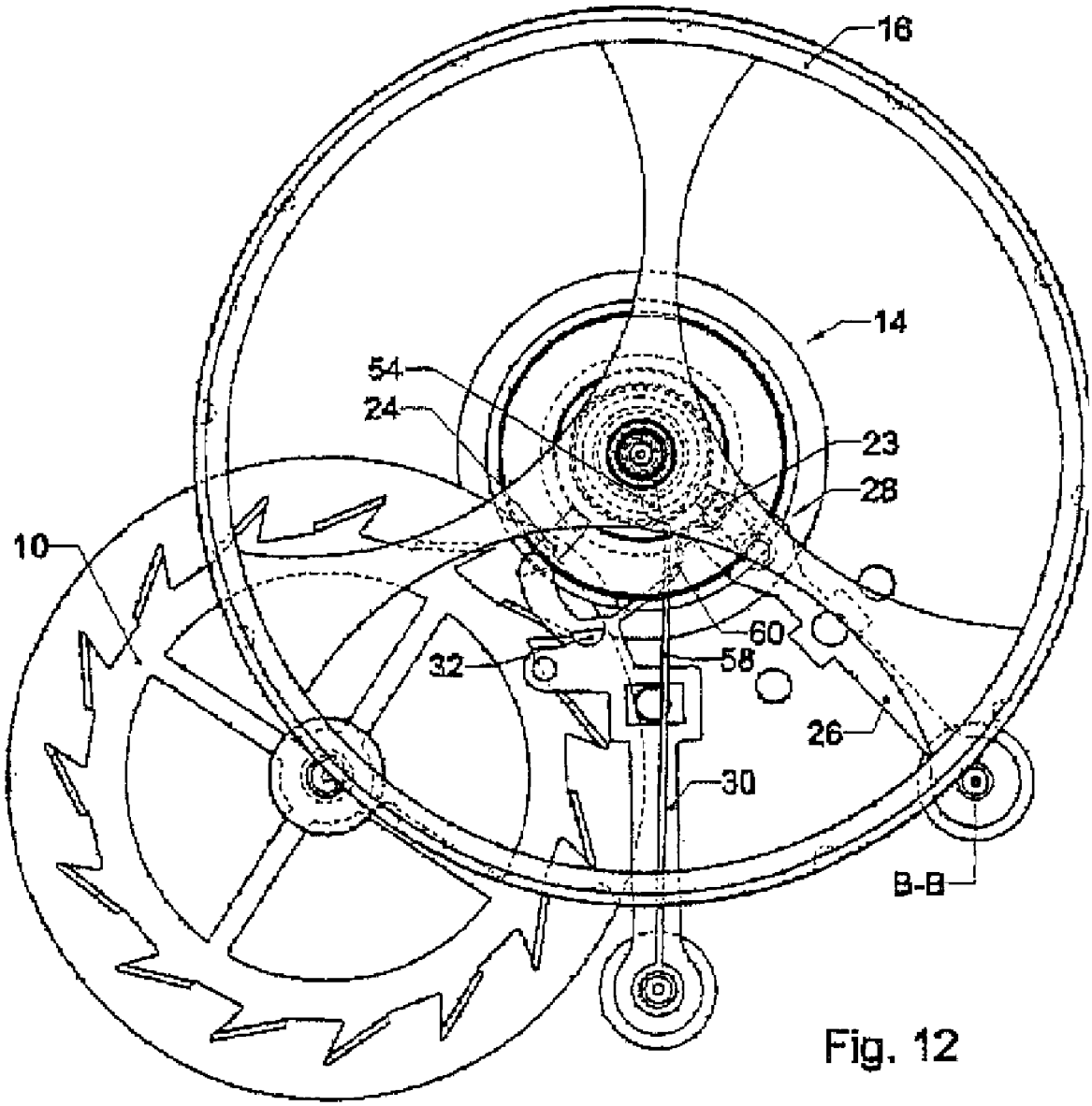
Figure 13:
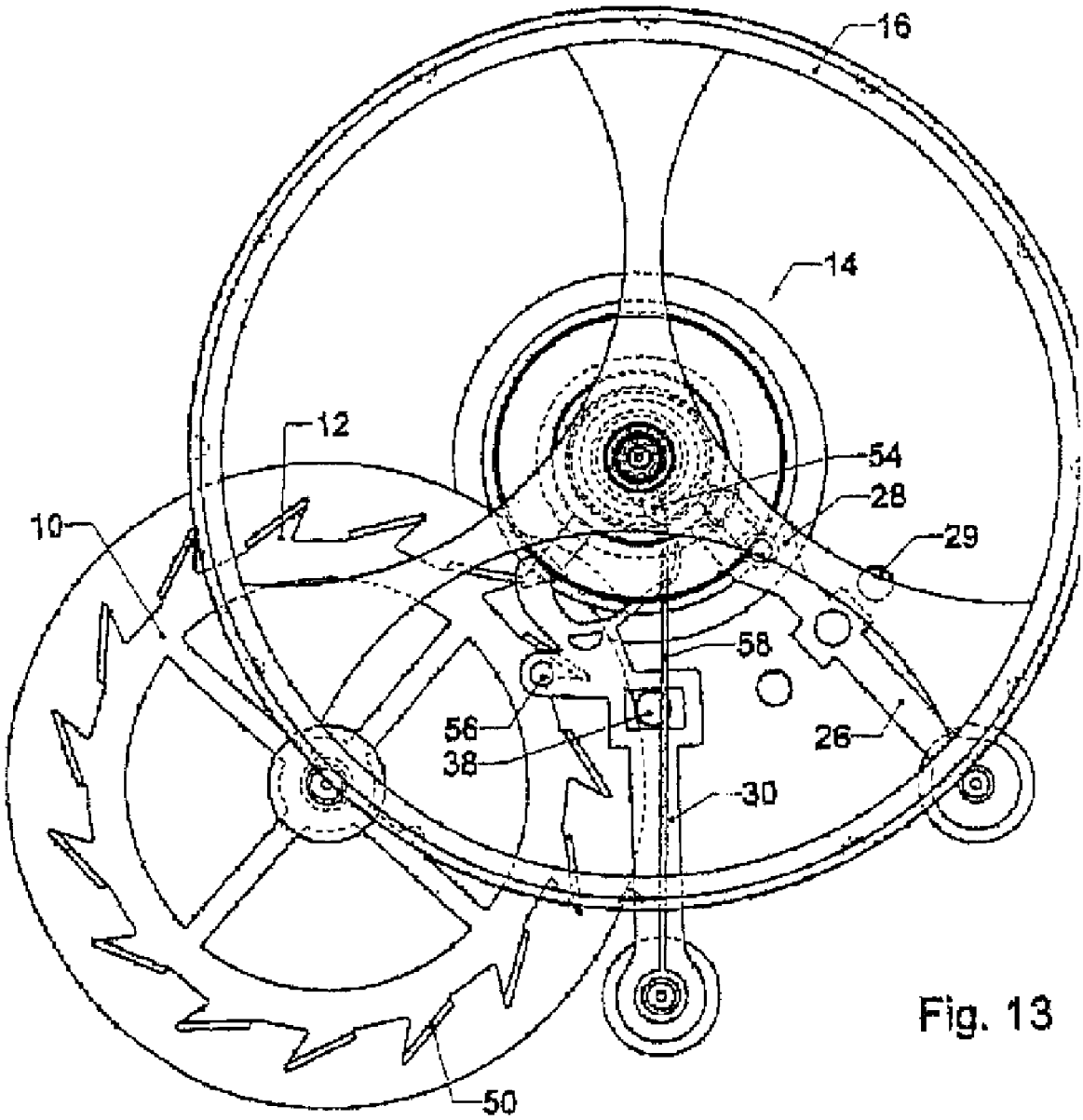
Figure 14:
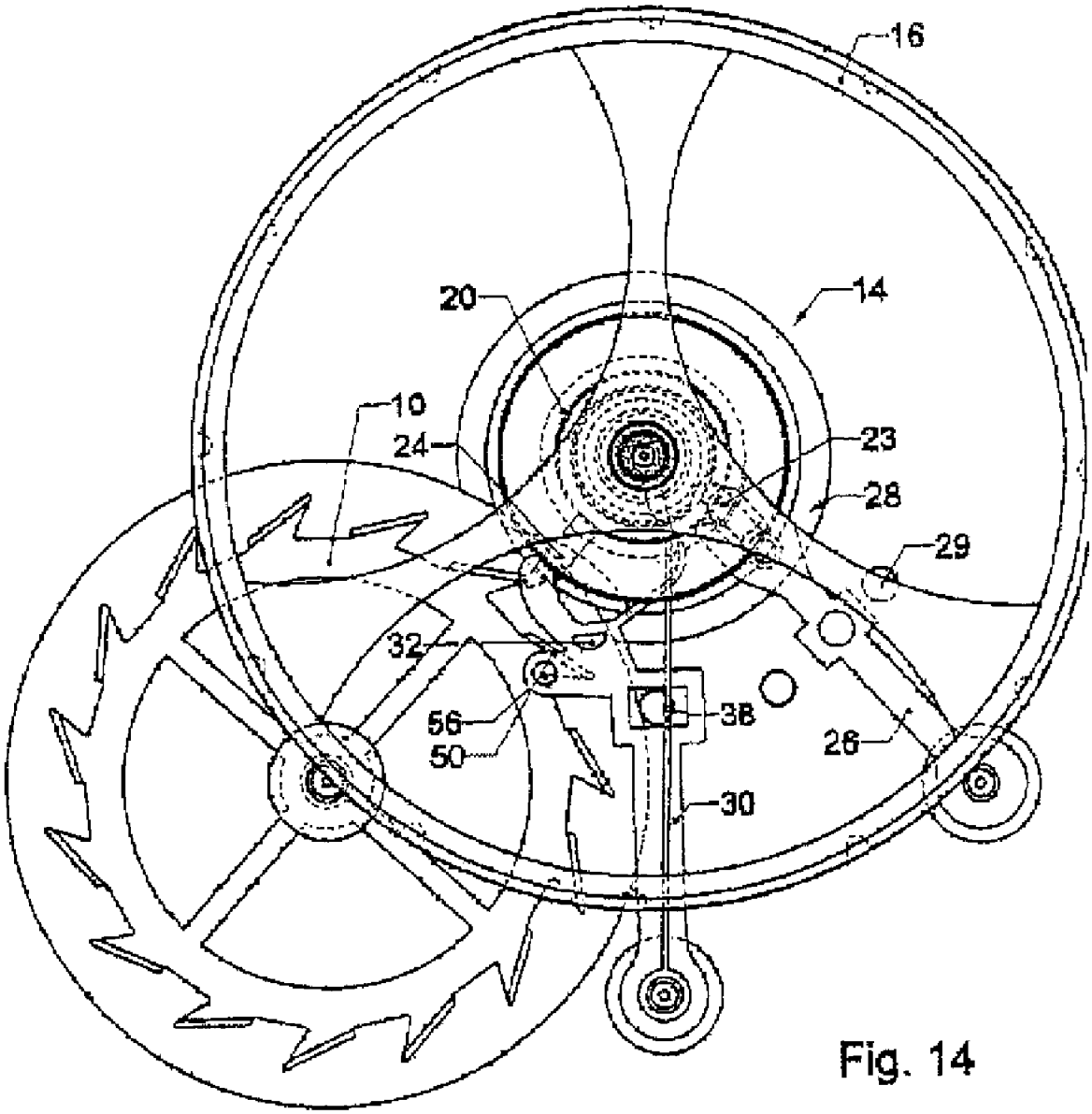
Figure 15:
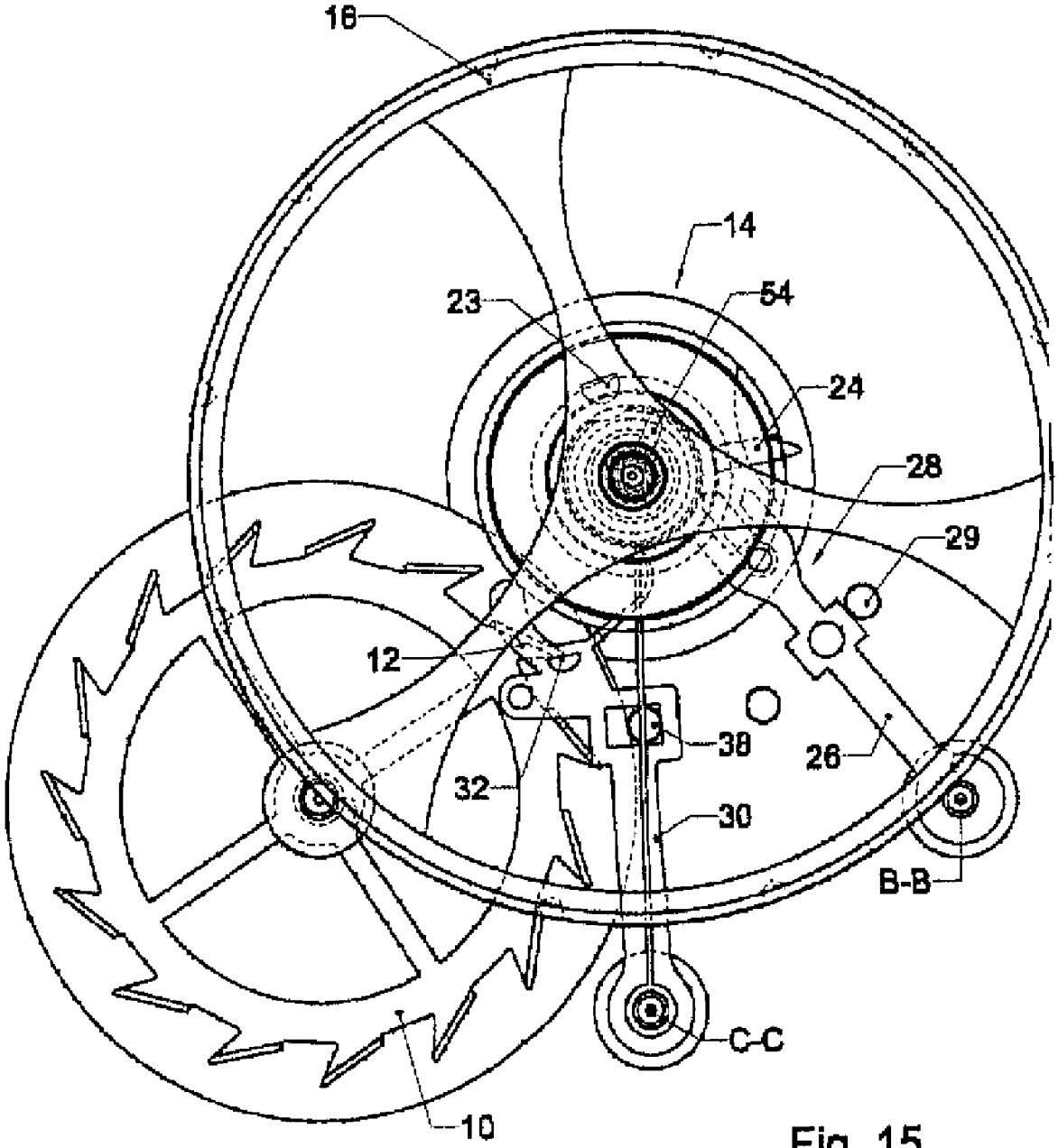
Figure 16:
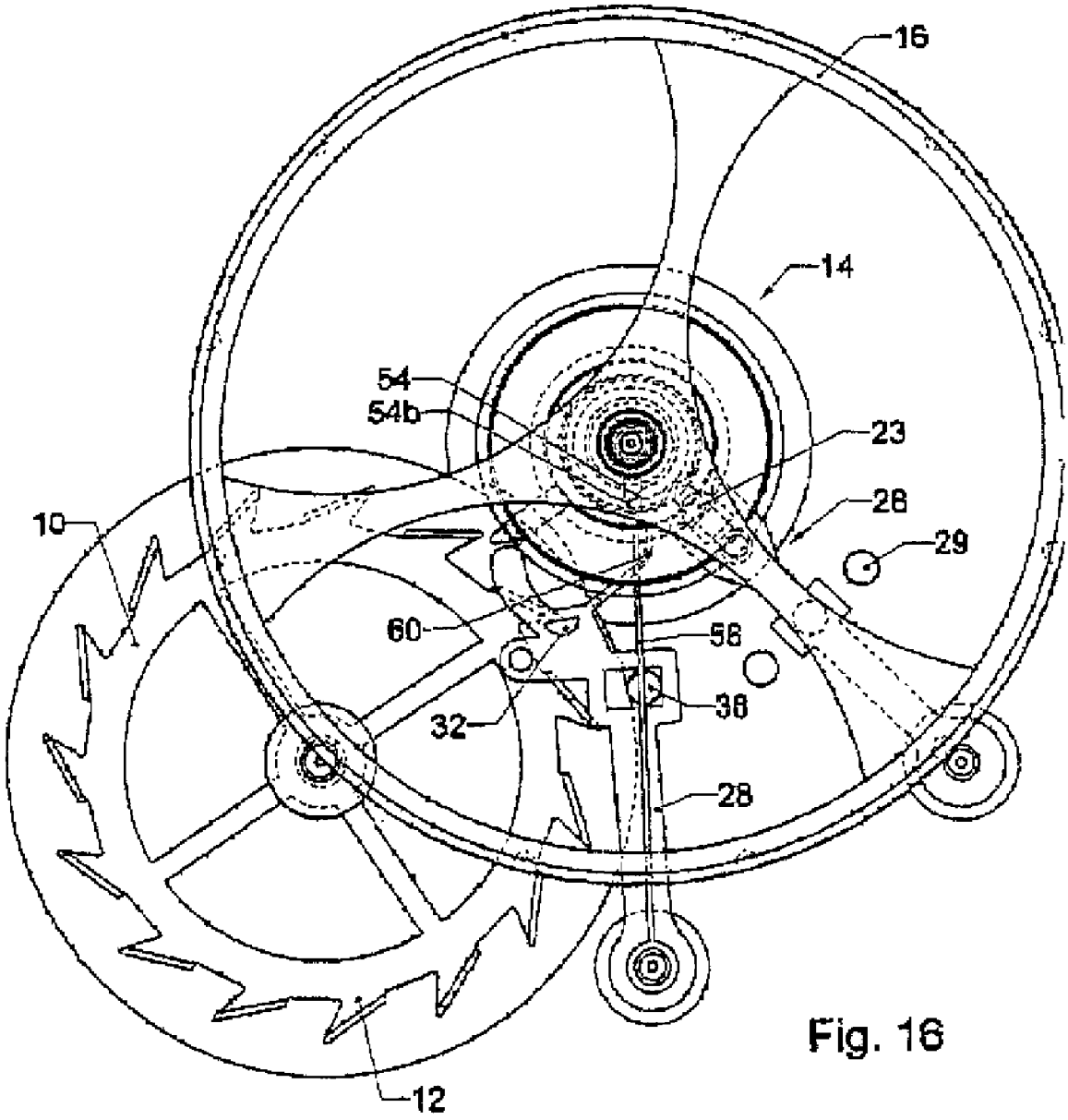

The roller 14 includes a third level 52 superposed coaxially to the level 22 and provided with a release pallet 54 visible in FIG. 10. The latter ends in a point having a straight portion 54*a* and a circular-arc-shaped portion 54*b*.

The limiting and control members are still made up of arms 26 and 30, which are each mounted pivotably on independent axes, respectively BB and CC. The arms 26 only include the fork 28 and a magnet 55. The stops 29 are made of a soft magnetic material, the attraction of which with the magnet 55 ensures the pull which holds the lever in its first and second stable positions.

Figure 1:
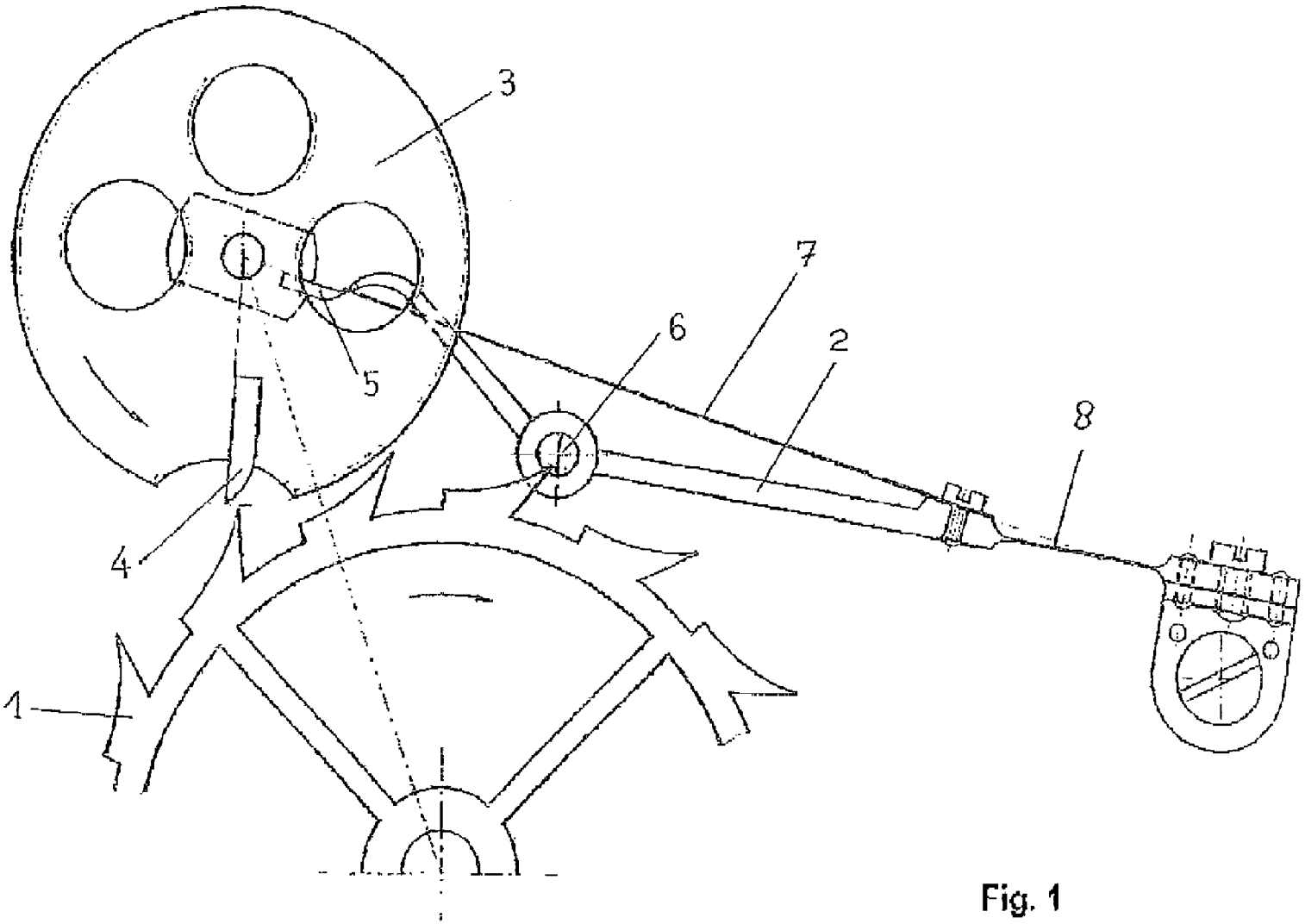
Fig. 1 PRIOR ART
FIG. 1 is a view of a traditional detent escapement as discussed above.

The arm 30 is comparable to the detent of the escapement mechanism of the same name illustrated in FIG. 1. It is equipped with a return pin 56 designed to cooperate with the inner surface of the boards 50 in order to provide the return system. It bears an elastic member made up of a spring 58 mounted rigidly on CC, substantially parallel to the longitudinal axis of its base. The end of the spring 58 is designed to cooperate with the release pallet 54 (visible in FIG. 10), against the straight portion 54*a* in one swing and against the circular portion 54*b* in the other swing. The arm 30 extends, additionally, into a beak 60. The latter passes beneath the spring 58 and ends in a portion 62 rising perpendicularly to the plane of the arm 30 in such a way as to be laterally in contact with the spring 58, close to its end.

The working of the mechanism is illustrated in FIGS. 10 to 16.

FIG. 10

The escapement is locked and the balance wheel 16 is in the descending portion of its swing and is turning counterclockwise. The pin 23 and the impulse pallet 24 are free. The escape wheel 10 is fixed, in bearing contact upon the locking pallet pin 32, whereby the arm is pulled into bearing contact upon the stop 38.

The arm 26 is in its first stable position, held magnetically in bearing contact against a first of the stops 29.

The return pin 56 is free, above the rim of the escape wheel 10.

FIG. 11

The impulse 24 and release pallets 54 and the pin 23 pursue their descending cycle, and the latter enters into contact with the entry 28*a* of the fork 28. The arm 26 is then set in rotation about the axis BB in the clockwise direction. Simultaneously, the pallet 54 meets the end of the spring 58, in bearing contact upon the beak 60, the effect of which is to set the arm 30 rotating in the clockwise direction about the axis CC.

FIG. 12

The release pallet 54 continues its rotation and pushes the spring 58, the beak 60 preventing the latter from deforming. The movement of the arm 30 brings about the release of the escape wheel 10, which is no longer in contact with the locking pallet pin 32. The wheel 10 then rotates in the clockwise direction, kinematically driven by the barrel. The arm 26 is still set in rotation about BB by the pin 23.

FIG. 13

The release pallet 54 continues its rotation and leaves the contact of the spring 58. The tooth 12 which has just left the locking pallet pin 32 comes to bear, by its board 50, upon the return pin 56. The force generated by this bearing contact drives the arm 30 in the counterclockwise direction, with a view to returning it into its initial position.

FIG. 14

The pin 23 pursues its rotation and leaves the fork 28, the arm 26 being in the proximity of the second stop 29.

The pin 56 is no longer bearing upon the board 50 of the tooth 12, but the arm 30 is still not fully in its locking position.

Moreover, the plane BC of the tooth next to that which has just left the bearing pallet 34 enters into contact with the pallet 24 of the level 20 in order to provide the impetus.

Thus, the control member has performed a period movement for a period less than the first swing of the oscillation of the balance wheel.

FIG. 15

The balance wheel 16 and the roller 14 complete their swing in the counterclockwise direction. The pin 23 and the impulse 24 and release pallets 54 are free and are in the ascending portion of their swing. The fork 28 is now in its second stable position, held magnetically in bearing contact against the second stop 29.

The arm 30 has returned to its locking position, such as described in FIG. 10.

The escape wheel 10 is fixed, the tooth 12 which has just provided the impetus being bearing contact upon the locking lever 32.

FIG. 16

The balance wheel 16 and the roller 14 turn in the clockwise direction and are in the descending portion of their following swing.

In the course of their descending cycle, the pin 23 enters into contact with the exit 28*b* of the fork 28, returning it into the initial position of FIG. 10. The circular portion 54*b* of the release pallet 54 lifts the spring 58. The latter tensions slightly and regains its locking position as soon as it has been freed by the pallet 54.

The wheel 10 is fixed, in bearing contact upon the locking lever 32.

The limiting member therefore performs its periodic movement during the period of the oscillation of the balance wheel. When the balance wheel has completed this swing, a new cycle such as described above commences, and so on.

Figure 17:
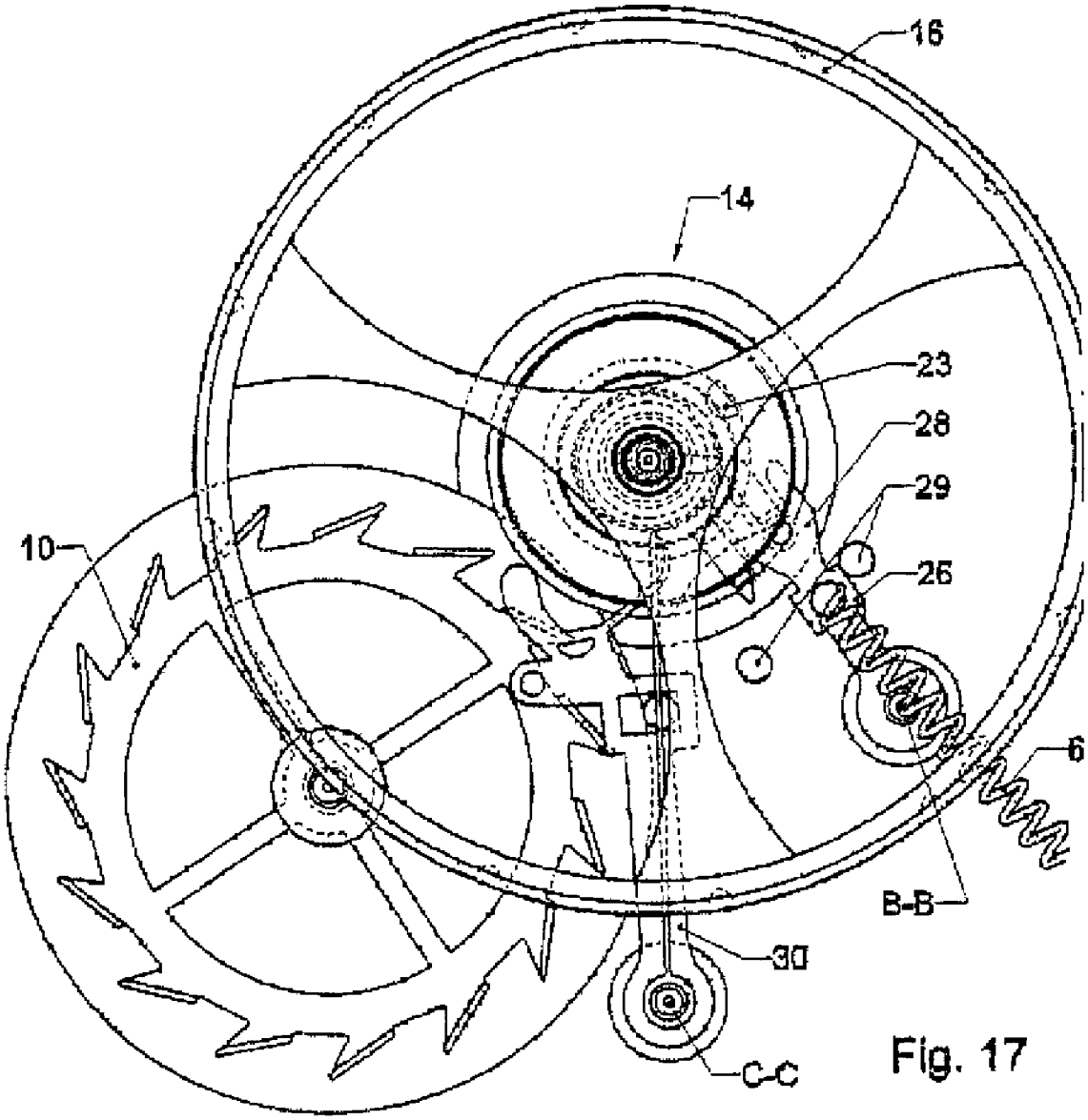
FIG. 17 is a variant of the second embodiment.

FIG. 17 illustrates a variant of this second embodiment, in which the arm 26 cooperates with a bistable spring 64, ensuring the maintenance of its first and second stable positions, in bearing contact against the stops 29. The passage from the one to the other is always effected by the interaction of the pin 23 upon the fork 28.

In the examples above and according to an important characteristic of the invention, the periods of the first arm 26 and of the second arm 30 correspond to a swing and an oscillation, respectively, of the balance wheel 16.

The examples above are only illustrations of the invention. Thus, the return systems described in the two embodiments are compatible with the two versions of the control member.

The invention claimed is:

1. An escapement for a mechanical watch, comprising:

an escape wheel kinematically connected to a power source, a roller mounted on a balance wheel including, on two different levels, a pin and an impulse pallet cooperating with said wheel, a pivoting member performing a periodic movement in the course of which it cooperates with said pin and a periodic movement of which is limited by two stops, a control member provided with a locking pallet pin performing, from a stable position in which a tooth of said wheel is bearing upon said locking pallet pin, a periodic movement in the course of which said wheel is freed and provides an impetus to said impulse pallet, wherein said pivoting member and the control member are connected together by a jumper, an end of which is shaped so as to provide a first stable bearing surface and a second stable bearing surface, said bearing surfaces pulling on a pallet integral with the control member, said bearing surfaces being applied alternately against the pallet integral with the control member via a spring cooperating with the jumper, and the control member includes a return part that cooperates with teeth of the escape wheel to limit pivoting of the control member, while the pivoting member continues its movement driven by the pin of the balance wheel, making the pallet pass from the first bearing surface to the second bearing surface during a first half of a cycle of said periodic movement of the balance wheel, the pin of the balance wheel bringing the pallet back into contact with the first bearing surface during a second part of the cycle of said periodic movement of the balance wheel.

2. The escapement as claimed in claim 1, in which said pivoting member is made up of an arm mounted pivotably about an axis ending in a fork cooperating with the pin of the balance wheel so as to move between a first stable position and a second stable position which are defined by a first stop and a second stop, said bearing surfaces ensuring that the arm of said pivoting member is held in said first and second stable positions.

3. The escapement as claimed in claim 1, in which said pivoting member and said control member are coaxial.

4. The escapement as claimed in claim 1, in which said control member comprises two arms extending in two directions from a pivot axis, one of which bears said locking pallet pin and the other of which bears a return pallet intended to cooperate with the teeth of the escape wheel.

* * * * *